United States Patent [19]

Wynar

[11] Patent Number: 4,831,808

[45] Date of Patent: May 23, 1989

[54] SELF-ADJUSTING WALLBOARD CLIPS

[76] Inventor: Roger N. Wynar, 19 Parkside Ave., Hamburg, N.Y. 14075

[21] Appl. No.: 104,649

[22] Filed: Oct. 5, 1987

[51] Int. Cl.[4] ..... E04B 5/52

[52] U.S. Cl. ..... 52/715; 52/489; 52/509; 52/363; 52/281

[58] Field of Search ..... 52/280, 281, 283, 361, 52/363, 481, 483, 489, 509, 512, 582, 586, 714, 715, 712

[56] References Cited

U.S. PATENT DOCUMENTS

| | | | |
|---|---|---|---|
| 2,321,671 | 6/1943 | Grotta | 52/712 X |
| 3,308,590 | 3/1967 | Ettore et al. . | |
| 4,117,644 | 10/1978 | Weinar | 52/714 |
| 4,127,975 | 12/1978 | Judkins | 52/489 |
| 4,221,095 | 9/1980 | Wynar | 52/489 |
| 4,296,580 | 10/1981 | Weinar | 52/281 |
| 4,333,286 | 6/1982 | Weinar | 52/281 |
| 4,467,578 | 8/1984 | Weinar | 52/281 |
| 4,467,579 | 8/1984 | Weinar | 52/281 |
| 4,498,272 | 2/1985 | Adams | 52/714 |

FOREIGN PATENT DOCUMENTS

| | | | |
|---|---|---|---|
| 1041267 | 10/1978 | Canada | 52/489 |
| 1362162 | 12/1964 | France | 52/483 |
| 296415 | 8/1963 | Netherlands | 52/715 |

*Primary Examiner*—James L. Ridgill, Jr.
*Attorney, Agent, or Firm*—Eric P. Schellin

[57] ABSTRACT

Disclosed is a wallboard panel construction including first and second abutting wallboard panels secured to generic framing members by a series of distortable clip pairs, each of the clips having substantially flat, coplanar plate and tongue portions, extending at substantially right angles and in opposite directions from central web portions, the web portions extending within the wallboard panel joints terminate with wallboard impaling pointed portions extending in the direction of and substantially parallel to the plate portions, the tongue portions are severed or slotted to form a fastener attachment terminal end portion, hinged from the plate portion by leaf spring edge portions, the first wallboard panel having a first series of clips, initially having coplanar plate and tongue portions with the terminal fastener ends mechanically secured (screwed or nailed) to a framing subsurface, the second wallboard panel having a second series of identical clips with tongue portions urged between the first wallboard panel back surface and the framing subsurface, the second wallboard panel and attached clips spaced from the subsurface by the fastener (screw or nail) head thickness, thus lifting the first wallboard panel, distorting the first series of fastened clips, which retain the wallboard panel assembly in permanent tension.

9 Claims, 2 Drawing Sheets

SELF-ADJUSTING WALLBOARD CLIPS

BACKGROUND OF THE INVENTION

1. Field of the invention

This invention relates to a ordinary drywall construction and particularly to an alternative to common wet compound treated, taped-joint gypsum drywall wherein pre-finished, gypsum wallboard panels are invisibly secured to generic framing members, such as wood or metal studs and furring. Unlike ordinary drywall, pre-finished gypsum panels have square (not tapered) edges that abut with inconspicuous joints. The advantages of using pre-finished panels include fast, clean installation, single trade responsibility and the ability to remove and salvage the panels and framing components for reuse.

2. Description of the Prior Art

Many of the "demountable" or "movable" wall systems utilize pre-finished wallboard panels secured with special, edge appended, rigid clip pairs holding the panels to the framing in a "tongue and groove" relationship such as those described in my U.S. Pat. Nos. 4,117,644 and 4,221,095, judkins U.S. Pat. No. 4,127,975 and others. Such clips are rigidized with deformed plate and tongue portions which space the panels a fixed distance from the framing and provide clearance for screw or nail fastener heads.

Unlike rigid clips, the present invention encourages controlled deflection of one clip in each pair to provide variable spacing as dictated by the thickness of different type fastener heads and the "distorted" clips retain the panel assembly in "rattle proof" tension.

The pairs are opposing identical clips formed of a single piece of resilient material, having substantially flat plate portions, tongue portions extending from said plate portions and coplanar therewith, web portions extending at a right angle from said plate portions, said web portions terminating with a wallboard impalling point portions extending in the same direction, essentially parallel to and overlying said plate portion so that the plate portions may contact the back surface of the wallboard panel while the pointed portions penetrate the wallboard panel edges.

The clips are preferably made of a spring material such as heat tempered steel, with coplanar plate and tongue portions cut from a single sheet in which central portions of the tongue material have been severed or removed to define spaced leaf spring edges hinged to fastener attachment terminal end, that may be screw or nail fastened to a framing substructure.

In practice a first series of clips, impaled along the concealed edge of a first wallboard panel, said first series of clips initially having coplanar plate and tongue portions with said terminal fastener ends mechanially secured (screwed or nailed) to a framing subsurface, said second wallboard panel having a second series of identical clips with tongue portions urged between the first wallboard panel back surface and the framing subsurface, said second wallboard panel and attached clips spaced from the subsurface by the fastener (screw or nail) head thickness, thus lifting said first wallboard panel, distorting said first series of fastened clips, which retain the wallboard panel assembly in permanent tension. The fastened clip resists the lifting and so adjusts to any fastener head thickness to minimize the space between the wallboard panels and the subsurface. This is particularly important in "Fire-Rated" assemblies where the spread of flame and smoke through the joints must be minimized. The resilient clip will even re-adjust during a fire with the calcination of the gypsum panel core. The distorted clips also exert "lock-washer" tension and prevent screw fasteners from loosening under the constant vibration present in every partition installation.

3. Object of the invention

It is an object of the invention to provide mechanical clip appendant which will invisibly secure wallboard panels in tension to ordinary substructure framing.

A particular object of this invention is to provide a building structure, such as a wall, wherein resilient fastener appendants coengageably secure wallboard panels along abutting panel edges in a tongue and groove relationship.

Yet another object of the invention is to provide a mechanical clip appendant which will adjust to fastener head thickness so as to minimize wallboard panel spacing from the framing subsurface.

Further objects and advantages of the invention will be brought out in the drawings and in this description, in which the purpose is to disclose a preferred embodiment of the invention, without placing limitations thereon.

DESCRIPTION OF A PREFERRED EMBODIMENT

Figure 1:
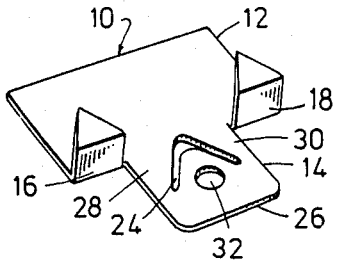
FIG. 1 is a pictorial view of a self-adjusting wallboard clip.

Referring to FIG. 1, self-adjusting wallboard clip 10 is shown formed of a single sheet of material, such as spring steel. Very useful clips have been produced using S.A.E 1050 heat-treated spring steel, but any resilient material, even plastic could be used. The clip 10 is comprised of a flat plate portion 12, a tongue portion 14 extending from said plate portion, a pair of central web portions 16 and 18, spaced by said tongue portion, extending at a substantially right angle from said plate portion and an impaling point portions 20 and 22, each extending from a web portion in a direction essentially parallel to and overlying said plate portion. Tongue portion 14 has been "V" severed or slotted 24 to form a fastener attachment terminal end 26, hinged from tapered leaf spring edges 28 and 30. A fastener hole 32 in shown in attachment terminal 26. Plate portion 12 and tongue portion 14 are planar when the resilient clips are in the relaxed position (shown) but deflection of the attachment terminal end 26 (encourage by "V" slot 24) can be controlled by the length and shape of the leaf spring edges 28 and 30. The tapered leaves 28 and 30 for instance, deflect in a broad spiral arc with a short "S" return to the fastener attachment terminal end 26 which can deflect parallel with plate portion 12. The same size clip can be engineered for various weight panels by changing only the shape and length of the leaf spring forming slot. Only slight variations are required since the resistance to deflection is a function of the square of the distance between the fastener attachment terminal end and the plate portion. A useful alternative would have the pointed portions reversed or directed as the "tongue" portion, the "plate" portion (now a tongue) would then be slotted or severed to form a hinged terminal end as previously described. Other clip configurations, such as the single web clip disclosed in the Ettore Patent (U.S. Pat. No. 3,228,164) could be made more useful if the tongue portion were slotted or severed to form a hinged terminal end as taught by this invention. It should be noted that while only wall constructions are illustrated for simplicity, ceiling and other panel assemblies could easily be constructed with the distortable clips.

Figure 2:
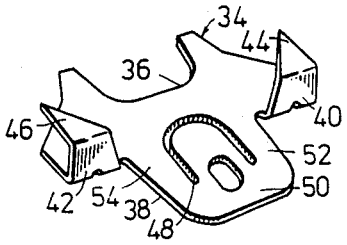
FIG. 2 is a pictorial view of a preferred configuration of a more resilient self-adjusting wallboard clip.
Figure 3:
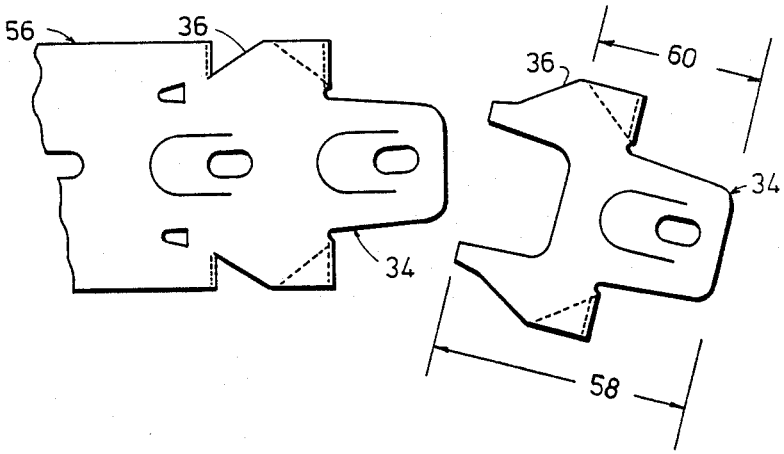
FIG. 3 is a top planar view of a "die strip" fragment showing one method of manufacturing the more resilient self-adjusting clips.

Referring to FIG. 2, a self-adjusting wallboard clip 34 similar to that shown in FIG. 1 is also formed of a single sheet of material, such as spring steel. The clip 34 is comprised of a modified (more resilient) flat plate portion 36, a tapered tongue portion 38 extending from said plate portion, a pair of central web portions 40 and 42, spaced by said tongue portion extending at substantially right angles from said plate portion and divergent point portions 44 and 46, each extending from a web portion in a direction essentially parallel to and overlying said plate portion. Tongue portion 38 has been "U" slotted 48 to form a fastener attachment terminal end 50, hinged from tapered leaf springs 52 and 54. The flat plate portion 36 of clip 34 is a modified "U" configuration to save material in manufacture as best seen in FIG. 3 where clip 34 has been severed from continuous strip 56 (shown fragmented) where nested clips have an effective length 58 but a small (die travel) actual length 60.

Figure 4:
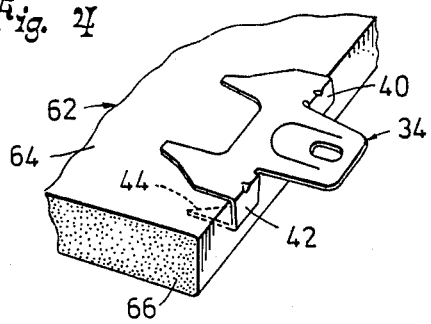
FIG. 4 is pictorial view of a typical self-adjusting clip, edge-impaled on an uninstalled wallboard panel fragment.

In FIG. 4, clip 34 is shown appended to a typical wallboard panel (fragment) 62 shown with back surface 64 up. In practice all of the clips are usually installed on each panel while stacked. A hammer or suitable tool drives webs 40 and 42 forcing points 44 and 46 into the panel core 66.

Figure 5:
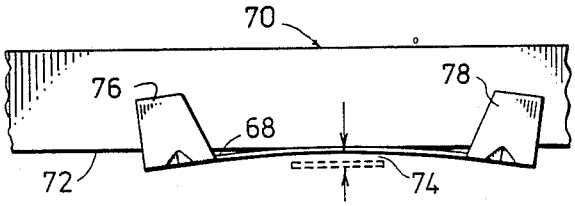
FIG. 5 is a side planar view of a wallboard edge fragment showing the advantageous "distortion" caused by the outwardly directed points of the self-adjusting clips.

In FIG. 5 a careless installer failed to keep the plate portion 68 flat against panel 70 back surface 72. The clips would not be properly gauged were it not for the inward deflection 74 of plate 68 caused by divergent points 76 and 78. The deflection 74, which is present to some degree in every installed clip, also provides rigidity since the plate portion 68 now arcuate.

Figure 6:
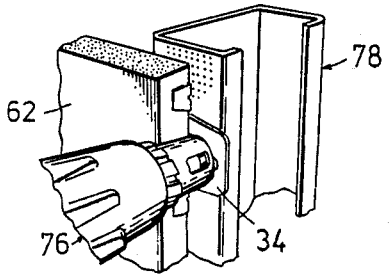
FIG. 6 is a pictorial view of a wall fragment showing a typical self-adjusting clip being mechanically screw fastened to an ordinary metal stud.
Figure 7:
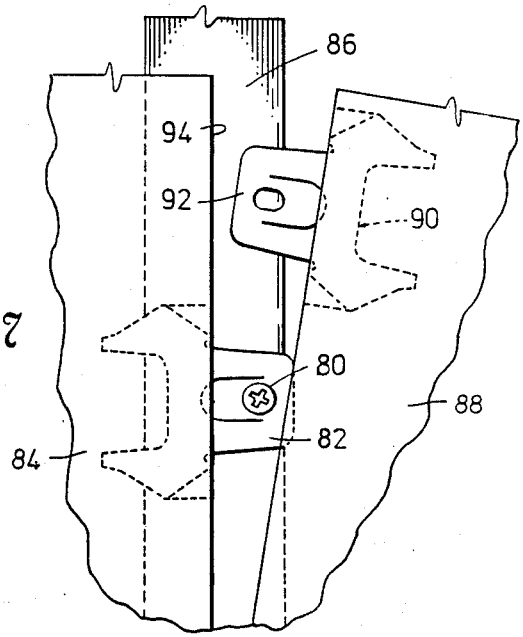
FIG. 7 is a front planar view of a wall fragment showing the progressive assembly of the clips at a typical wallboard joint (open)

In FIG. 6 a mechanical screw-gun 76 is shown driving a self-drilling, self-tapping screw (hidden) into typical metal stud 78 to attach clip 34 appended to typical wallboard panel 62. When wood framing is encountered, a nail or staple might be substituted for the screw fastener In FIG. 7 the progressive installation sequence is illustrated where screw 80 fastened first clip 82 holds a first wallboard panel 84 against framing runner 86. A second wallboard panel 88 with offset second clip 90 will engage the first wallboard panel in a 'tongue and groove' manner when second clip 90 tongue 92 enters the space 94 between first wallboard panel 84 and framing member 96. While a pair of identical clips are illustrated and considered most convenient, the second clip does not need the severed tongue, in fact almost any type clip could be used as a "second clip".

Figure 8:
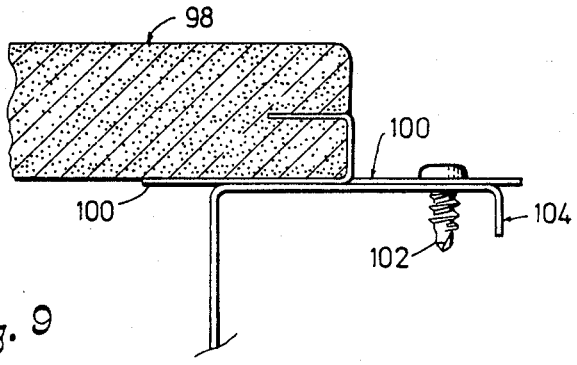
FIG. 8 is a cross-sectional view of wall fragment showing a first wallboard panel with an "undistorted" selfadjusting clip screw fastened to a typical metal stud.
Figure 9:
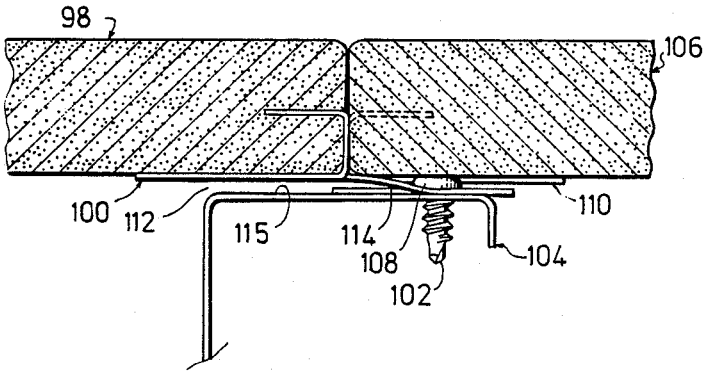
FIG. 9 is a cross-sectional view of the wall fragment of FIG. 8 with the second wallboard panel installed causing advantageous "distortion" in the screw fastened self-adjusting clip.

FIG.'S 8 and 9 are enlarged cross-sectional views detailing the cooperative effect of a typical pair of self-adjusting clips. In FIG. 8 a typical first wallboard panel 98 with relaxed first clip 100 is screw 102 fastened to typical metal stud 104. In FIG. 9 a second abutting wallboard panel 106 spaced from the framing 104 by screw head 108 completes the joint. Since the torque portions of the clips are very rigid near the joinder line, the second clip 110 lifts the first wallboard panel 98 and distorts 114 the first fastened clip 100 which retains the assembly in tension. The self-adjusting feature of the assembly is easily seen in FIG. 9 where wallboard panels 98 and 106 remain spaced 112 from the framing surface 115 only the thickness of the fastener head 108.

Figure 10:
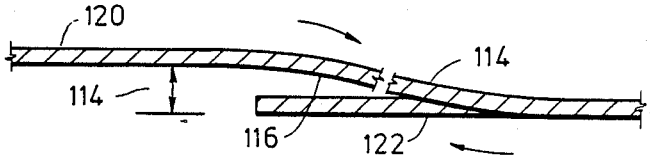
FIG. 10 is an enlarged cross-sectional view of a "distorted" self-adjusting clip fragment.

In FIG. 10 an enlarged view of the leaf spring portion of the clips shows how distortion 114 is resisted by reverse torsional bending moments 116 and 118 because the appended plate portion 120 and the fastened terminal end 122 remain flat and parallel.

It is thought that the wallboard clips and joint assembly of the present invention and many of its attendant advantages will be understood from the foregoing description and it will be apparent that various changes may be make in the form, construction, material and arrangement of the parts thereof without departing from the spirit and scope of the invention or sacrificing all of its material advantages, the form hereinbefore described being merely a preferred or exemplary embodiment thereof.

What is claimed as new and desired to be secured by Letters Patent of the United States is:

1. A fastener clip made of resilient sheet material useful for installing panels onto a substrate comprising a flat plate portion, a flat tongue portion, said plate portion and said tongue portion being coplanar and extending in opposite directions, said plate portion having a first edge portion, said tongue portion having a second edge portion, said first edge portion and said second edge portion having a contiguous area along portions thereof, at least two mutually displaced web portions, said web portions each extending substantially perpendicularly in like direction from said first edge portion, said web portions being displaced from each other by said tongue portion, said web portions terminating with impaling pointed portions extending substantially parallel to and displaced over said plate portion in a direction opposite to said tongue portion, said tongue portion defining a substantially arcuate configured slot therethrough, said slot having its apex terminating at substantially the said contiguous area and defining an ear means substantially coplanar and contiguous with said tongue portion, said ear portion including fastener attachment means therefor whereby when said fastener clip is secured to a substrate by said fastener attachment means, said tongue portion and said plate portion are capable of being mutually tensioned into a non-coplanar position in response to any mutually out of alignment position of said panels being secured by said fastener clip.

2. The fastener clip of claim 1 wherein said arcuate configured slot has a substantially V-shaped configuration.

3. The fastener clip of claim 1 wherein said arcuate configured slot has a substantially U-shaped configuration.

4. The fastener clip of claim 1 wherein said flat plate portion has a plurality of flat spaced coplanar leg portions extending oppositely to said tongue portion.

5. The fastener clip of claim 1 wherein said fastener attachment means of said ear portion defines an aperture therethrough.

6. The fastener clip of claim 5 wherein the said arcuate configured slot has a substantially V-shaped configuration.

7. The fastener clip of claim 6 wherein said flat plate portion has a plurality of flat spaced coplanar leg portions extending oppositely to said tongue portion.

8. The fastener clip of claim 5 wherein said arcuate configured slot has a substantially U-shaped configuration.

9. The fastener clip of claim 8 wherein said flat plate portion has a plurality of flat spaced coplanar leg portions extending oppositely to said tongue portion.

* * * * *